US005382360A

United States Patent [19]

Vosper

[11] Patent Number: 5,382,360

[45] Date of Patent: Jan. 17, 1995

[54] SPILL FREE CLEAN OUT TRAPS AND FILTERS

[76] Inventor: George W. Vosper, 149 Earl Street, Kingston, Canada, K7L 2H3

[21] Appl. No.: 970,704

[22] Filed: Nov. 3, 1992

Related U.S. Application Data

[60] Division of Ser. No. 618,799, Nov. 28, 1990, Pat. No. 5,159,724, which is a continuation-in-part of Ser. No. 67,808, Jun. 30, 1987, Pat. No. 5,095,553, which is a continuation-in-part of Ser. No. 497,204, May 23, 1983, abandoned.

[51] Int. Cl.[6] ..... B01D 35/02

[52] U.S. Cl. ..... 210/239; 210/248; 210/438; 210/440; 210/441

[58] Field of Search ..... 210/248, 232, 311, 438, 210/440, 299, 305, 316, 441, 444, 453, 239; 4/292

[56] References Cited

U.S. PATENT DOCUMENTS

| | | | |
|---|---|---|---|
| 277,888 | 5/1883 | Connolly | 137/247.27 |
| 1,210,201 | 12/1916 | Perkins | 137/247.35 |
| 2,742,101 | 4/1956 | Stambaugh | 137/247.4 |
| 3,725,964 | 4/1973 | Whitsett | 4/191 |
| 3,751,734 | 8/1973 | Lumadue | 4/189 |
| 3,935,602 | 2/1976 | Kale | 4/292 |
| 4,158,897 | 6/1979 | Cocherel | 4/170 |
| 4,230,582 | 10/1980 | Tuleja | 210/311 |
| 4,264,442 | 4/1981 | Jackson | 210/86 |
| 4,275,760 | 6/1981 | Kessel | 137/546 |
| 4,524,795 | 6/1985 | Ericson et al. | 137/216.2 |

FOREIGN PATENT DOCUMENTS

| | | | |
|---|---|---|---|
| 39019 | 5/1892 | Canada . | |
| 103102 | 1/1907 | Canada . | |
| 118591 | 5/1909 | Canada . | |
| 218965 | 5/1922 | Canada . | |
| 40292 | 7/1887 | Germany . | |
| 571074 | 12/1957 | Italy | 210/440 |
| 177198 | 5/1935 | Switzerland . | |
| 849695 | 9/1960 | United Kingdom . | |

*Primary Examiner*—Matthew O. Savage
*Attorney, Agent, or Firm*—Lowe, Price, LeBlanc & Becker

[57] ABSTRACT

A spill free clean out type sink trap includes a cover sealingly and detachably mounted on a container and, in one embodiment, respective individual inlet and outlet conduits are spaced apart laterally from one another. The conduits both project downwardly below the cover into the container in which case, during use, the water level in the container is spaced from the cover. This is an air space of sufficient volume to receive and hold the liquid, normally retained in the conduits, when the seal between the cover and container is broken. In another embodiment, inlet and outlet conduits are concentric and the outlet conduit projects into a further conduit to an extent such that the lower open end thereof is below the normal liquid level. The further conduit projects sufficiently downwardly into the container such that the liquid free volume in the container is greater than the volume of liquid contained in the lower end of the inlet conduit and the further conduit.

3 Claims, 2 Drawing Sheets

SPILL FREE CLEAN OUT TRAPS AND FILTERS

REFERENCE TO CO-RELATED APPLICATION

This application is a division of application Ser. No. 07/618,799, filed Nov. 28, 1990, now U.S. Pat. No. 5,159,724, which is a continuation-in-part of Ser. No. 07/067,808, filed Jun. 30, 1987, now U.S. Pat. No. 5,095,553, which is a continuation-in-part of Ser. No. 06/497,204, filed May 23, 1993, now abandoned.

FIELD OF INVENTION

This invention relates to spill free clean out traps and filters.

BACKGROUND OF INVENTION

Easy-clean traps for sink drains and the like are known in the art, as exemplified by the teachings in U.S. Pat. Nos. 3,935,602, issued Feb. 3, 1976 to H. D. Kale, U.S. Pat. No. 2,742,101, issued Apr. 17, 1956 to C. Stambaugh, and U.S. Pat. No. 1,210,201, issued Dec. 26, 1916 to W. H. Perkins. In each instance these traps have a removable lower portion that can be quickly and readily detached to retrieve any foreign objects that may have collected therein. The problem with such traps is that when the bottom is removed, liquid in the pipe spills and this must be collected in a separate container. Removal of the bottom of the trap usually results in a spillage of the liquid in the surrounding area. Cabinets and other enclosures around the sink limit the space and in many instances there is insufficient room to get a container in to collect the liquid in the pipe.

Various types of traps are illustrated in the following references:

United States Patents

- U.S. Pat. No. 4,275,760 issued Jun. 30, 1981 to B. Kessel
- U.S. Pat. No. 4,264,442 issued Apr. 28, 1981 to D. Jackson
- U.S. Pat. No. 4,230,582 issued Oct. 28, 1980 to A. Tuleja
- U.S. Pat. No. 4,158,897 issued Jun. 26, 1979 to M. Cocherel
- U.S. Pat. No. 3,751,734 issued Aug. 14, 1973 to R. Lumadue
- U.S. Pat. No. 3,725,964 issued Apr.10, 1973 to G. Whitsett
- U.S. Pat. No. 277,888 issued May 22, 1883 to P. Connolly Canadian Patents 39,019 issued May 28, 1892 to J. Carroll
103,102 issued Jan. 6, 1907 to J. Paddon
118,591 issued May 25, 1909 to J. Donoran
218,965 issued May 23, 1922 to E. Johansson

SUMMARY OF INVENTION

An object of the present invention is to provide an improvement to the foregoing such that the liquid in the pipes can be collected without spillage in the removable portion of the trap, thereby resulting in no spillage.

In order to overcome the foregoing disadvantages, applicant has provided a trap wherein there is sufficient liquid free volume in the container of the trap, to collect and hold the liquid in the conduits when the seal is broken between the removable container portion of the trap and the remaining portion.

In one embodiment of this invention, a sink trap comprises a container detachably and sealingly connected to a cover. The liquid flow path is through an inlet conduit through the container and then through an outlet conduit with the direction of travel of the liquid in the inlet conduit opposite to that in the outflow with the reversal in flow direction taking place in the container. The open end of the conduits in the container are located a selected distance downwardly from the cover providing a liquid free space in the container above the normal liquid level therein. During normal use, the liquid has a liquid level in the inlet conduit which is higher than the normal liquid level in the container. Likewise, the liquid level in the outlet conduit is higher than the normal liquid level. The liquid free volume in the container above the normal liquid level is at least equal to and preferably greater than the volume of the portion of liquid contained in the inlet and outlet conduits above the liquid level so that when the seal between the container and cover is broken, the liquid in the conduits will flow into the volume in the container. This results in collection of all liquid in the container with no spillage occurring when removing the container to clean out the trap.

The container is preferably detachably connected to the cover by a threaded nut and for sealing purposes there may be provided a gasket between the container and the cover. The cover is also provided with threaded spigots on the upper side of the cover and continuations thereof project from the opposite side of the cover downwardly into the container. The conduits project into respective ones of the spigots and sealing is provided conventionally with ring or gland nuts having flanges cooperating with packing material.

In a further embodiment of the invention, the inlet and outlet conduits are concentric and the inlet conduit projects into a further conduit of larger diameter than the inlet conduit to an extent such that the lower open end thereof is below the normal liquid level. The further conduit projects sufficiently downwardly into the container such that the liquid free volume is greater than the volume of liquid contained in the lower end of the inlet conduit and the further conduit.

The foregoing embodiments may also be incorporated into a filter, such as a fuel filter having automotive and other types of applications.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

The invention is illustrated by way of example in the accompanying drawings wherein.

DETAILED DESCRIPTION OF PREFERRED EMBODIMENTS

Figure 1:
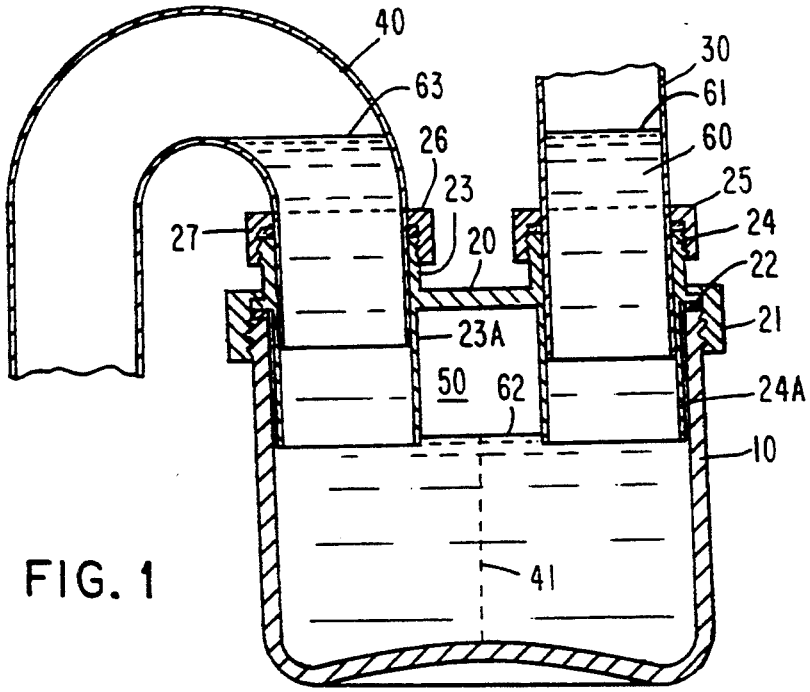
FIG. 1 is a vertical cross-sectional view of a sink trap provided in accordance with the present invention wherein there is an air space in the upper part of the trap.

Referring to the drawings, there is illustrated in FIG. 1 a sink trap comprising a container 10 detachably and sealingly connected to a cover 20. The liquid flow path is through inlet conduit 30 through the container and then through the outlet conduit 40. The direction of travel of the liquid in the inlet conduit is opposite to that in the outflow, the reversal of flow direction effectively taking place in the container. In the embodiment illustrated in FIG. 1, the open end of the conduits 30 and 40 in container 10 are located a selected distance downwardly from the cover (i.e. the upper end of the container) providing a liquid free space 50 in the container above the normal liquid level therein. During normal use of the trap, the liquid 60 has a level designated 61 in the inlet conduit, a level designated 62 in the container and a level designated 63 in the outlet conduit. The liquid free volume 50 in the container, above liquid level 62, is at least equal to and preferably greater than the volume of the portion of liquid 60 contained in the inlet and outlet conduits 30 and 40 above the liquid level 62 so that when the seal between the container 10 and cover 20 is broken, the liquid in the conduits will flow into the volume 50 in the container. This results in collecting all of the liquid in the container with no spillage occurring when removing the container 10 to clean out the trap.

In the embodiment illustrated in FIG. 1, the container 10 is detachably connected to the cover 20 by a threaded ring nut 21 and for sealing purposes there is provided a gasket 22 between the container and the cover. The cover 20 is also provided with threaded spigots 23 and 24 on the upper side of the cover and continuations thereof, designated 23A and 24A, project from the opposite side of the cover downwardly into the container. Conduits 30 and 40 project into respective ones of the spigots 24 and 23 and sealing is provided in a conventional manner by respective ring or gland nuts 25 and 26 having flanges cooperating with packing material 27.

In the embodiment illustrated in FIG. 1, the conduits 30 and 40 project preferably an equal amount into the container. Also, if desired, a screen or strainer 41 may be placed in the container to prevent the through flow of accidentally dropped possessions. The height of the screen need be no more than the normal water level 62 in the container.

Figure 2:
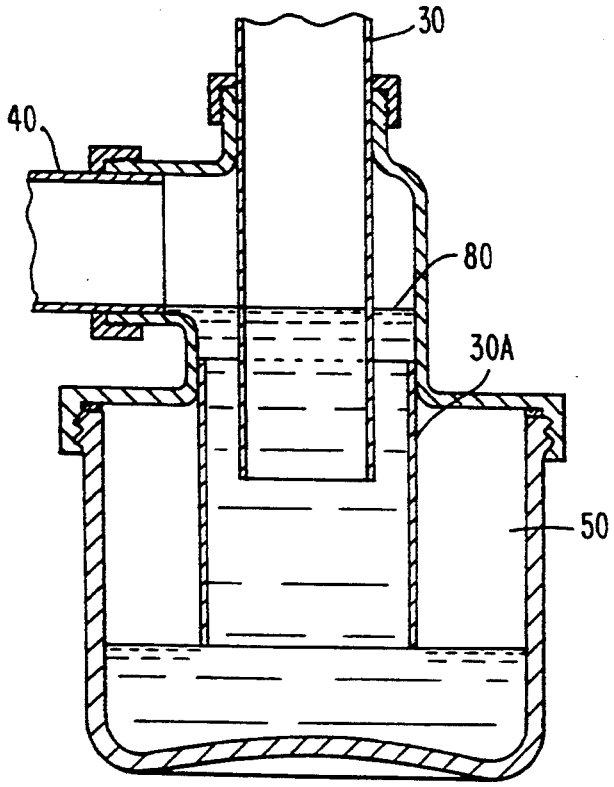
FIG. 2 is a vertical cross-sectional view of a sink trap provided in accordance with a further embodiment of the invention.

In FIG. 2, there is illustrated a still further embodiment wherein the inlet and outlet conduits are generally concentric. Inlet conduit 30 projects into a further conduit **30*a* (larger in diameter than conduit 30) to an extent such that the lower open end thereof is below the normal liquid level 80. Conduit 30*a* projects sufficiently downwardly into the container such that the liquid free volume 50 is greater than the volume of liquid contained in the lower end of inlet conduit 30 and the further conduit 30*a***.

Figure 3:
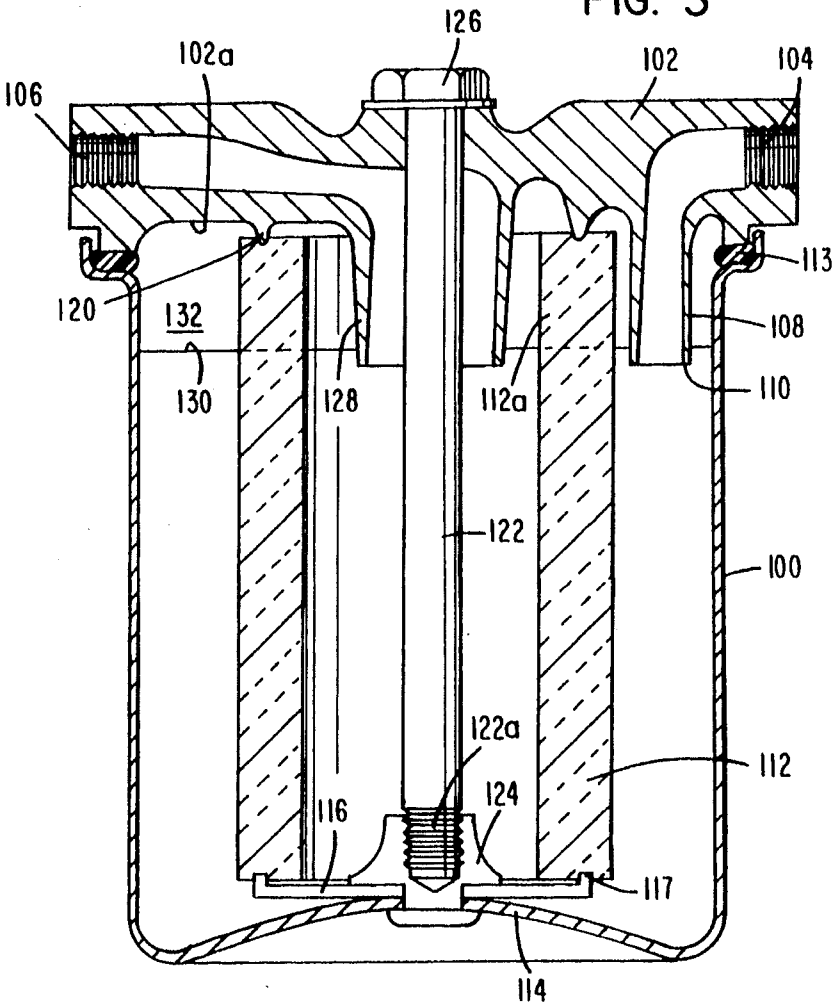
FIG. 3 is a vertical cross-sectional view of a fuel filter in accordance with the present invention.

FIG. 3 is an illustration of a fuel filter embodiment of the present invention wherein a fuel filter bowl or container 100 is closed at its upper open end with a cover 102 having an inlet 104 and an outlet 106 at diametrically opposed positions. The inlet 104 terminates in a downwardly extending inlet conduit 108 located radially adjacent the side wall of container 100. The bottom opening 110 of inlet conduit 108 is vertically spaced below a gasket 112 which seals the cover 102 to the upper edge of container 100. An annular filter 112 extends vertically between the container bottom 114 and the cover bottom **102*a*. The filter 112 is maintained in position by means of a bottom bracket 116 engaging the bottom edge of the filter at 117, and a downwardly projecting annular protrusion 120 engaging the top edge of the filter. A holddown clamping bolt 122 extending longitudinally along the center axis of container 100 has a lower end 122*a* threadedly received in a nut 124 secured to the container bottom. A holddown nut 126 engages the upper surface of cover 102 to clamp the cover to the container 100, thereby fixing filter 112** in its depicted operating position.

Cover 102 further includes an outlet conduit 128 which extends downwardly from cover bottom **102*a* in concentric relation to the longitudinal axis of the container. Inlet conduit 108 and outlet conduit 128, as depicted in FIG. 3 terminate at approximately the same elevational position below cover bottom 102*a* and together define the liquid level 130 of fluid (fuel) entering the container through inlet conduit 108 where the fluid passes through filter 112 before exiting the container through outlet conduit 128 and thereafter outlet 106**.

By extending inlet and outlet conduits 108, 128 downwardly into container 100 (relative to cover bottom **102*a*), there is created a liquid-free space 132 in the container above the normal liquid level 130 therein. During normal use of the filter, the liquid has a level designated 130 in the inlet conduit 108 and a corresponding level in the outlet conduit. The liquid-free volume 132 in the container 100, above liquid level 130, is preferably at least equal to and greater than the volume of the portion of liquid contained in the inlet and outlet conduits 108, 128 above the liquid level 130 so that when the seal between the container 100 and cover 102 is broken, the liquid in the conduits will flow into the volume 132 in the conduit. This results in collecting all of the liquid in the container with no spillage occurring when removing the container 100** to change the filter.

It will also be appreciated that, since the upper portion **112*a* of filter 112 extends above the liquid level 130 during normal operation, this exposed upper portion of the filter remains unclogged during normal operation. In the event the downwardly depending portions of the filter become clogged to the point of adversely impeding the flow of fluid through the filter, it is an advantageous feature of this invention to remove the container from the cover via loosening the bolt so as to enable filter 112** to be inverted with the unclogged portion now disposed adjacent the container bottom until a fresh filter can be obtained.

Figure 4:
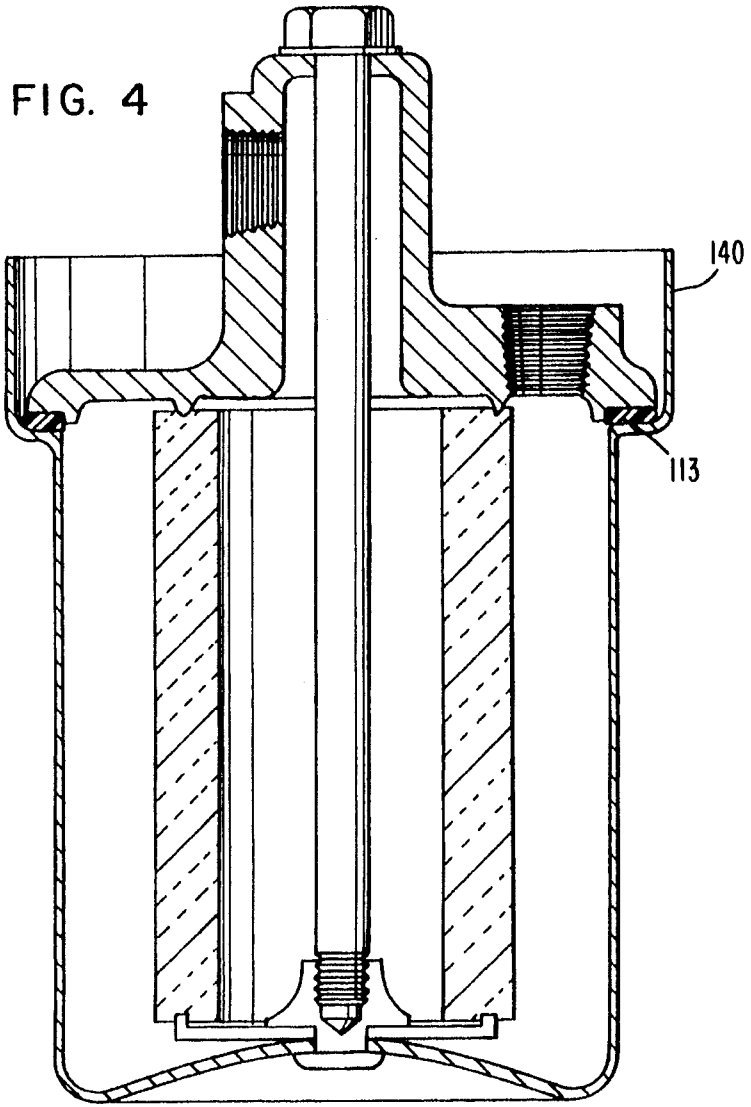
FIG. 4 is a vertical cross-sectional view of a further embodiment of a fuel filter in accordance with the present invention.

As depicted in FIG. 4, a portion of the container side wall may be provided to project upwardly from gasket 113 to define a cylindrical volumetric region located above the cover. When the cover is removed from container 100, this volumetric region essentially functions as the liquid-free volume 132 in the FIG. 3 embodiment by permitting fluid in portions of the inlets and outlets extending above the liquid level to flow downwardly into the container to occupy this additional volumetric region defined by an upstanding uppermost portion 140 of the container side wall.

While the improvement has been described herein with reference to drain traps, the same principle can apply to fuel line traps.

I claim:

1. An apparatus for filtering a liquid comprising:

(a) a container having a closed bottom and an open top;

(b) a cover detachably mounted on said container sealingly closing said open top, said cover including a liquid inlet conduit and a liquid outlet conduit extending into said cover at respective positions spaced apart from one another respectively for the inflow of liquid into the container via said inlet conduit and outflow of such liquid from the container via the outlet conduit, said conduits each having fluid flow communication with the interior of the container via respective ones of a pair of openings spaced downwardly from a bottom surface of the cover facing the interior at a position below a surface of the liquid in the container, said container thereby being only partially filled with liquid during operation of said apparatus which is at a normal fluid level spaced a selected amount downwardly from the bottom surface of said cover and above said openings for the inlet and outlet conduits, each of said inlet and outlet conduits having liquid therein and extending above said apparatus; said container having sufficient volume above the normal fluid level therein during use so as to receive and hold the liquid normally retained in said conduits when the seal between the cover and the container is broken; and (c) an annular filter mounted within the container and extending between said inlet conduit and said outlet conduit from a position proximate the bottom surface of the cover to a position proximate the bottom of said container, whereby said filter projects upwardly above the liquid surface to define an upper portion which remains unclogged during normal operation, and wherein said filter can be removed from said container and replaced in an inverted position so that the unclogged portion of the filter is disposed adjacent the container bottom until a fresh filter can be obtained.

2. An apparatus as defined in claim 1, wherein the open top of said container includes an upper edge, and wherein the cover rests on said upper edge of the container.

3. An apparatus as defined in claim 1, wherein the container is cylindrical.

* * * * *